United States Patent [19]

Willis

[11] Patent Number: 4,938,343

[45] **Date of Patent: * Jul. 3, 1990**

[54] PREASSEMBLED DISPLAY STAND AND CONTAINER ASSEMBLY

[76] Inventor: William T. Willis, 3638 Wentworth La., Lilburn, Ga. 30247

[ * ] Notice: The portion of the term of this patent subsequent to Mar. 21, 2006 has been disclaimed.

[21] Appl. No.: 212,278

[22] Filed: Jun. 27, 1988

Related U.S. Application Data

[63] Continuation-in-part of Ser. No. 72,627, Jul. 13, 1987, Pat. No. 4,813,536.

[51] Int. Cl.[5] ..... B65D 5/52

[52] U.S. Cl. ..... 206/44 R; 206/45.22; 211/132; 229/117; 248/174

[58] Field of Search ..... 206/44 R, 45.2, 45.21, 206/45.22, 45.27, 45.25, 45.3; 229/41 R, 41 C; 211/132; 248/174

[56] References Cited

U.S. PATENT DOCUMENTS

| | | | |
|---|---|---|---|
| 2,291,265 | 7/1942 | Viglietta | 229/41 R |
| 2,296,126 | 9/1942 | Ullrich | 229/41 B |
| 2,825,519 | 3/1958 | Potts et al. | 229/41 R |
| 3,300,166 | 1/1967 | Wojciechowski | 248/174 |
| 3,692,174 | 9/1972 | Ross | 206/45.22 |
| 3,918,576 | 11/1975 | Taub | 206/44 R |
| 4,523,675 | 6/1985 | Schröter | 206/44 R |
| 4,583,705 | 4/1986 | Schmitt | 248/174 |
| 4,651,871 | 3/1987 | Schröter | 206/44 R |
| 4,726,476 | 2/1988 | Smith | 211/132 |
| 4,813,536 | 3/1989 | Willis | 206/44 R |

FOREIGN PATENT DOCUMENTS

| | | | |
|---|---|---|---|
| 2561089 | 9/1985 | France | 248/174 |

*Primary Examiner*—Bryon Gehman

*Attorney, Agent, or Firm*—Thomas & Kennedy

[57] ABSTRACT

A preassembled display stand and container assembly comprises a rectangular box container including side panels and a bottom formed from interleaved flaps. A display stand has front and back walls and accordian foldable side walls with the front and back walls connected at their tops to opposed ones of the interleaved flaps. The stand is constructed and arranged to collapse to a flat configuration and wrap around the container to form a shipping configuration of the assembly, and the container and stand collapse laterally as an integrated unit to a flat stackable configuration of the assembly. When the stand is unfolded it supports the container and goods therein above the floor for display and sale.

4 Claims, 3 Drawing Sheets

PREASSEMBLED DISPLAY STAND AND CONTAINER ASSEMBLY

REFERENCE TO RELATED APPLICATION

This application is a continuation-in-part of copending application Ser. No. 072,627, filed July 13, 1987 now U.S. Pat. No. 4,813,536.

BACKGROUND OF THE INVENTION

The present invention relates generally to shipping containers and particularly to shipping containers that serve as display stands for articles shipped therein.

It is common for producers of small goods to ship their goods to retail stores in cardboard containers. Typically, the containers are made by their manufacturer and shipped in a flat stacked configuration to the producer of the small goods where the containers are assembled and are filled with the goods, closed about the goods and delivered to the retail store.

At the retail store, the containers typically are cut open and the goods shipped therein removed and placed into shelves for display and sale. Removal of the goods from the containers by the merchants is time consuming and wasteful since the shipping containers, being designed for shipping only, are usually discarded after being unpacked. In many instances, it is difficult to display advertisements or information about the goods which have been placed on conventional shelves without partially hiding merchandise displayed on other shelves. Further, if the retail merchant is required to remove the goods from the container, the producer of the goods loses control over the manner in which the goods are displayed at the point of sale of the goods. This can cause the sales of the goods to decrease if the goods are poorly displayed.

Previous attempts have been made to solve these problems through the use of shipping containers that also serve as display stands for merchandise shipped therein. Examples of such containers are illustrated in U.S. patents of Ross 3,692,174, Taub 3,918,576, Hostad 4,191,288, and Schroter 4,651,871. In general, these patents show containers in which the goods are shipped and stands for supporting the containers in an elevated position above the floor or other support surface. The Taub and Hostad patents also show display panels for attachment to containers and which display printed advertisements or other information concerning the goods in the container. The Schroter patent shows a stand that collapses and wraps around its container for shipment.

While the prior art containers are useful, they have not proven to be complete solutions to the problems discussed above. This is because most of them require some assembly of the container by the producers of the goods and later by a clerk at the retail store which can be intricate and frustrating. Further, assembly at the retail store by an inexperienced stock person can require as much time as removal of the goods from conventional shipping containers and placing the goods on the shelving of the retail store.

A further problem with the prior art is that the display panels for the containers which extend in an upright attitude from a side wall of the containers do not have adequate means of vertical support and tend to droop or are easily pulled over by customers who retrieve goods from the container.

SUMMARY OF THE INVENTION

Briefly described, the present invention is a shipping container and display stand assembly which is shipped in a flat stacked configuration from the manufacturer of the container to the producer of the goods, is opened and packed with the goods, collapsed to a shipping configuration and delivered to the retail merchant where it is reopened and serves as a display stand for the goods shipped therein. The container assembly includes a collapsable rectangular box container, a collapsible stand for supporting the container and a display panel that folds over the container for shipment and which stands upright adjacent the goods for advertising the goods in the container.

The stand is hingedly connected to the bottom of the container and is adapted to collapse accordian fashion to a flat configuration and fold around the outside or periphery and over the top of the container for shipping. In addition, the stand and connected container are constructed to collapse laterally as a unit to a flat configuration so that the manufacturer of the container can stack several units together for shipment to the producer of the goods. The display panel has foldable or pivotable reinforcement wings that pivot outwardly to maintain the panel in an upright position when unfolded to a flat configuration for display.

The container can be maintained in its folded shipping configuration in which goods are packed in the container by an ancillary box or wrapper of suitable wrapping material. To convert the shipping container and display stand assembly from its packed, shipping and storage configuration to its display configuration, the outside wrapper or ancillary box is removed. This allows the folded stand to unfold under the influence of its resiliency and gravity such that the container and goods therein are supported atop the unfolded stand. The display panel also unfolds under the influence of its resiliency and the reinforcement wings are pivoted out to 90° positions so as to urge the panel into a flat upright configuration.

Thus, it is an object of this invention to provide an improved shipping container that also serves as a display unit for goods shipped therein.

Another object of this invention is to provide a shipping container and display stand assembly having a stand that collapses to a flat configuration and wraps around the outside of the container and the goods therein, forming a compact package for shipping.

Another object of this invention is to provide a shipping container and display stand assembly that collapses laterally as an integrated unit to a flat configuration so that several units can be stacked for shipment to a producer of goods.

Another object of this invention is to provide a shipping container and display stand assembly with a stand that requires no assembly, is easily erected and supports the container and goods therein above the floor for display and sale.

Still another object of this invention is to provide a shipping container and display stand assembly having an advertisement display panel attached to the container and that includes support wings to support the panel in a flat upright display position.

An additional object of this invention is to provide blanks cut from cardboard or the like from which a shipping container and display stand assembly of the type described may be formed.

Other objects, features and advantages of the present invention will become apparent upon reading the following specification, when taken in conjunction with the accompanying drawings.

DETAILED DESCRIPTION

Figure 1:
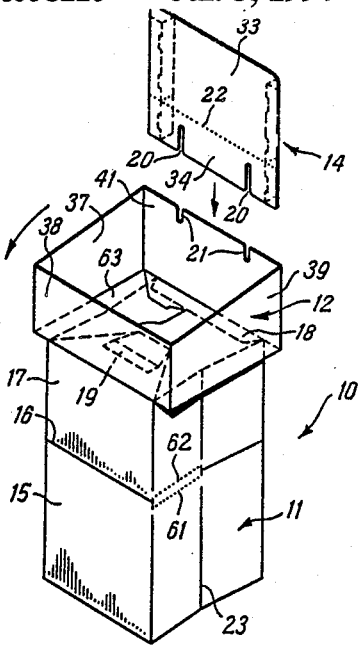
FIG. 1 is a perspective view of the display stand of the invention in its unfolded display configuration, with the advertisement display panel displaced above the container to illustrate the connection therebetween.

Referring now in more detail to the drawings, in which like numerals indicate like parts throughout the several views, FIG. 1 shows a shipping container and display stand assembly 10, constructed in accordance with principles of the invention, as it appears in its unfolded display configuration. A generally rectangular open box container 12 is seen to be supported by a generally tubular or hollow rectangular stand 11. An advertisement display panel or header 14 is releasibly attachable to the container 12. The container 12 is generally box-shaped having a front panel 38, a back panel 41, side panels 37 and 39 and a bottom panel 63. The bottom panel 63 is defined by four bottom forming flaps 64, 66, 67 and 68 (FIG. 8) which are hingedly attached to the bottom edges of the front, back and side panels and folded inwardly 90° to define the bottom panel 63.

The back panel 41 of the container 12 has slots 21 adapted to couple with the slots 20 formed in the bottom edge of the display panel 14 so that the display panel can be releasibly mounted to the back panel of the container. The display panel 14 is scored along broken line 22 so that it can be folded across the top of the container while mounted to the back panel 41 forming a compact configuration of the panel and container for shipping.

Figure 3:
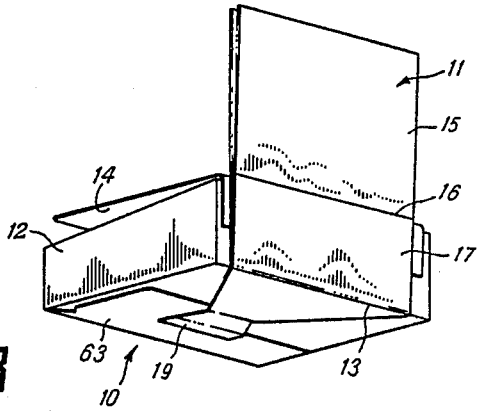
FIGS. 3 and 4 show the invention in progressively more unfolded configurations.

Stand 11 has a front wall, a back wall, and accordian foldable side walls and is adapted, as discussed hereinafter, to collapse accordian style to a flat configuration and fold around and over the top of the container 12 for shipping. The stand 11 is hingedly attached with, for example, glue to the bottom panel 63 of the container 12 via attachment tabs 18 and 19. As best seen in FIG. 3, attachment tab 18 is preferably attached to bottom forming flap 68 adjacent the back panel 41 and attachment tab 19 is attached to bottom forming flap 66 forwardly displaced from the attachment of tab 18.

Figure 2:
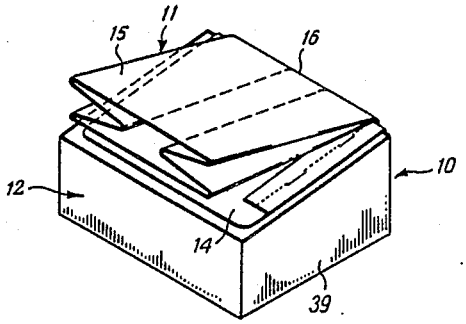
FIG. 2 is a perspective view of the invention in its folded shipping configuration.

FIG. 2 shows the shipping container and display stand assembly 10 as it appears in its accordian folded shipping configuration. The display panel 14 is folded along line 22 across the top of the container 12 and the stand 11 is collapsed to a generally flat configuration and wrapped around the back and over the top of the container forming a compact box-like structure.

Figure 4:
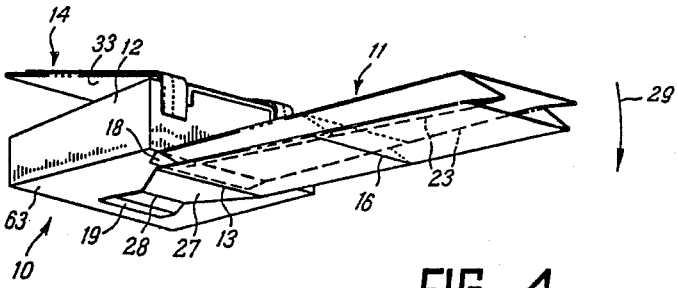

FIGS. 3 and 4 show the shipping container and display stand assembly 10 as it appears in two stages of unfolding from the shipping configuration of FIG. 2 to the display configuration of FIG. 1. These figures illustrate how the stand 11 is collapsed and folded around the container 12 for shipping. An elongated tab 27 is foldably attached to and extends from the top of the front wall of the stand 11 to mount at its distal end to bottom forming flap 68 via connecting tab 19. The panel 27 has a lateral fold line 28 and acts as a lever to force the stand open as it unwraps from the container as described below.

Figure 5:
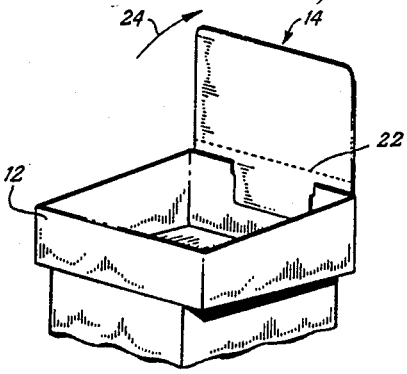
FIG. 5 is a partial perspective of the invention showing the display panel attached thereto.
Figure 6:
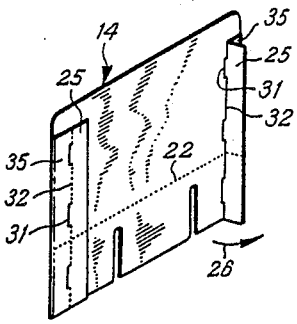
FIG. 6 is a perspective view of the rear of the display panel showing the reinforcement wings.

FIG. 5 shows the display panel 14 attached to the back panel 41 of the container 12 and unfolded along broken line 22 to an upright position. FIG. 6 shows the back of the display panel 14 and the support means for reinforcement of the display panel in its upright position. The support means is formed from a strip of material that is scored for folding along fold line 32. Fold line 37 defines a mounting portion 35 of said support means and a support wing 25. The mounting portion 35 is preferably foldably connected to the panel 33 along line 36 (FIG. 7) and is folded along line 36 and secured with, for example, glue to the back of the panel 33. Alternatively, the support means can be separate from display panel 33 and mounted thereto with, for example, glue.

The support wings 25 have pressure tabs 31 struck therefrom along fold line 32 and extending across the fold line into the mounting portion 35. Pressure tabs 31 are positioned to move into firm engagement with the back of the panel 33 as the support wings 25 pivot outwardly so as to maintain the wings in generally perpendicular relationship relative to the panel to support the panel in its unfolded upright position and to urge the panel to an unbowed flat configuration.

Figure 7:
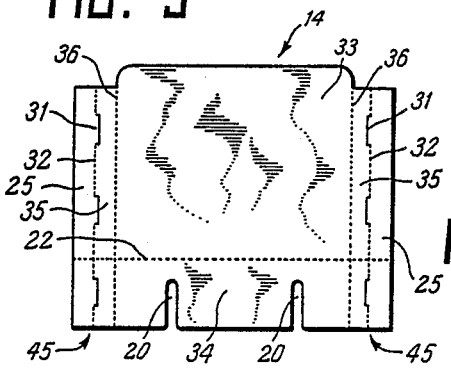
FIG. 7 is a plan view of a blank from which the display panel may be formed.
Figure 8:
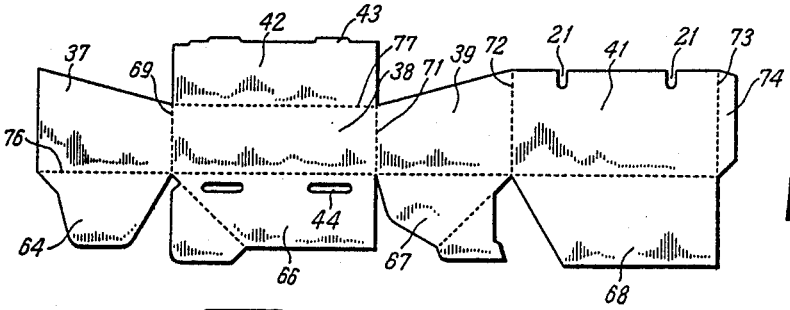
FIG. 8 is a plan view of a blank from which the container portion of the invention may be formed.
Figure 9:
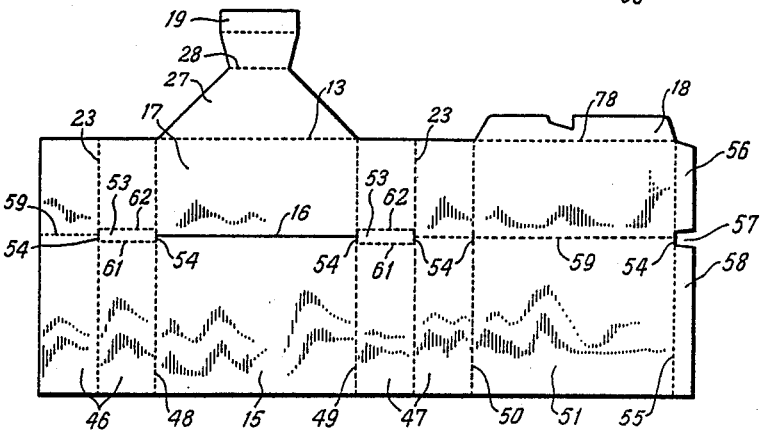
FIG. 9 is a plan view of a blank from which the stand portion of the invention may be formed.

FIGS. 7 through 9 illustrate blanks of cardboard from which the display panel, container and stand described hereinabove can be formed. The display panel blank of FIG. 7 is seen to have a fold line 22 which defines an upper panel portion 33 and a lower panel portion 34. The lower panel portion 34 has slots 20 for releasibly fastening the display panel to the container as discussed above. Other fastening arrangements can be used, if desired, to mount the display panel 14 to the container 12. Disposed on opposite sides of the upper and lower panel portions and connected thereto along fold lines 36 are support means 45. Each support means comprises a mounting portion 35 and a support wing 25 connected together at fold line 32. The support wing 25 has pressure tabs 31 struck therefrom along fold line 32 and the pressure tabs extend partially into the mounting portion 35. The pressure tabs 31 are formed by through scoring the cardboard around the edges of the tabs so that when the support wing 25 is pivoted along fold line 32, pressure tabs 31 remain coplanar with support wings 25.

FIG. 8 illustrates a blank from which the display container can be formed. The blank has a back panel 41, a front panel 38, and two side panels 37 and 39. Connected to the front, back and side panels are bottom forming flaps 64, 66, 67 and 68. These flaps are of a size and shape such that when the blank is folded to form the container and the tabs are folded along fold line 76, they cooperate to form the bottom panel 63 of the container.

An inner front panel 42 is connected along fold line 77 to front panel 38. The inner front panel 42 has a pair of securing tabs 43 and flap 66 has a pair of matching slots 44. The tabs 43 and slots 44 are arranged to couple together when flap 66 is folded to form bottom 63 and inner front panel 42 is folded along fold line 77 to be adjacent the front side 38 on the inside of the container. Back panel 41 has slots 21 formed along the top edge thereof for coupling with slots 20 in the display panel 14 allowing the display panel to be releasibly mounted to the backside of the container. Flange 74 is connected to the edge of back panel 41 and is adapted to be attached to the edge of side panel 37 when the blank is folded to form the container.

A blank from which the stand may be formed is shown in FIG. 9. It has a lower front wall 15 and an upper front wall 17 separated by through score 16. Connected along fold line 13 to the upper front wall 17 is elongated tab 27 which terminates at its upper extent in the attachment tab 19.

Connected to the upper and lower front walls along fold lines 48 and 49 are stand side walls 46 and 47. Each of the side walls has a longitudinal fold line 23 defining a front portion having double transverse fold lines 61 and 62, and a back portion having a single transverse fold line 59.

Connected along fold line 50 to side wall 47 is stand back wall having an upper portion 52 and a lower portion 51 separated by a horizontal fold line 59. Connected along fold line 78 to the top edge of upper back wall 52 is attachment tab 18. Attached along fold line 55 to the outermost edge of the back wall are upper and lower connecting tabs 56 and 58 separated by slot 57. This connecting tab is positioned and arranged to be attached to the outermost edge of side panel 46 when the blank of FIG. 9 is folded to form the stand. Through scores 54 are formed at the points on the front and side panels where horizontal and vertical fold lines intersect. These small through scores facilitate the folding of the assembled stand around the container when it has been collapsed to its flat configuration.

Figure 10:
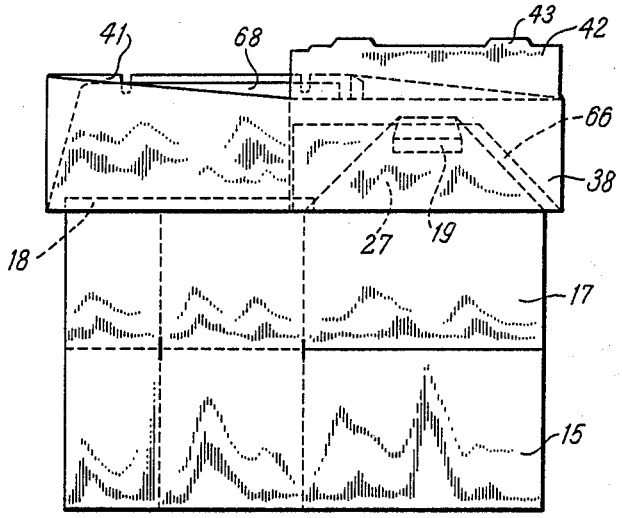
FIG. 10 is a front elevation of the stand and container in its laterally folded flat configuration.

FIG. 10 illustrates the shipping container and display stand assembly in its laterally collapsed substantially flat configuration with inner front panel 42 folded upwardly. Bottom forming flaps 66 and 68 (shown in broken line) are folded upwardly into the collapsed container. Bottom forming flaps 64 and 67 have been omitted for clarity in FIG. 10 but are also folded upwardly into the container similar to flaps 66 and 68.

Since tabs 18 and 19 of stand 11 are attached to flaps 68 and 66, respectively, the stand 11 also collapses laterally as tabs 66 and 68 move laterally relative to each other and fold upwardly into the container. The shipping container and display stand assembly is thus laterally collapsible as an integrated unit into a substantially flat configuration in addition to being foldable to a box-like shipping configuration as discussed hereinabove. Such lateral collapsibility is valuable to a manufacturer of the shipping container and display stand assembly because he can attach the stand to the container, collapse the entire unit laterally to its flat configuration and stack several units for shipment to the producer of goods.

Upon receipt of the laterally collapsed assembly by the producer of goods, the container and stand assembly is simply unfolded laterally from the flat configuration of FIG. 10 to the open configuration of FIG. 1. The container can then be packed with goods and the stand collapsed accordian style and wrapped around the container for shipment to the retailer as previously discussed.

Figure 11A:
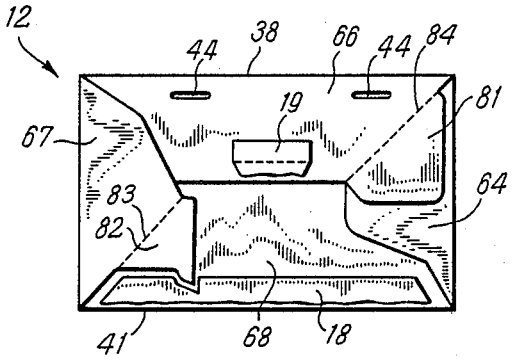
FIG. 11A is a bottom plan view of the container in its open configuration showing the relationship of the bottom forming flaps.
Figure 11B:
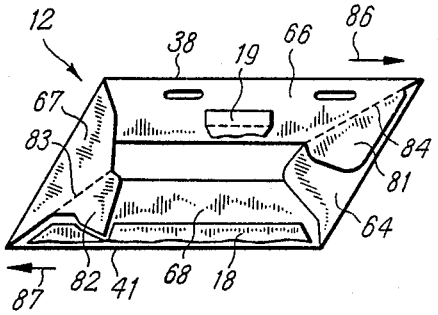
FIG. 11B is a bottom plan view of the container in an intermediate laterally folded configuration.
Figure 11C:
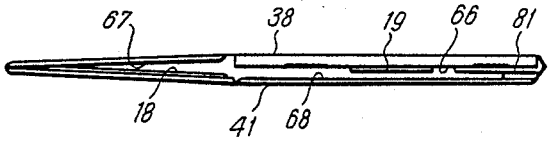
FIG. 11C is a bottom view of the container in its laterally folded flat configuration.

FIGS. 11*a*–11*c* are bottom plan views of the container 12 illustrating a preferred configuration of bottom forming flaps 64, 66, 67 and 68. Also shown is attachment tab 18 and connecting tab 19 of the stand 11 mounted to flaps 68 and 66 at preferred locations. FIG. 11*a* illustrates the flaps as they appear with the container in its open configuration and FIGS. 11*b* and 11*c* show the tabs as they appear as the container folds laterally to its flat configuration.

In FIG. 11*a*, flaps 64, 66, 67 and 68 are interleaved to define the bottom of the container. When the manufacturer forms the bottom, flap 68 is initially folded inwardly and flaps 64, 66 and 67, respectively, are folded inwardly with each overlying a portion of previously folded flaps. Gluing tab 81 is hingedly attached to flap 66 at fold line 84 and is glued or otherwise mounted to flap 64. Similarly, gluing tab 82 is hingedly attached to flap 7 and is mounted to flap 68 as indicated. Portions of the stand 11 including the attachment tab 18 and the connecting tab 19 are shown mounted to flaps 66 and 68 in preferred locations. Other portions of the stand have been omitted for clarity.

FIG. 11*b* is a bottom plan view of the container 12 showing the positions of the bottom forming flaps and the stand attachment tabs as the container is collapsed laterally to the flat configuration of FIG. 10. As front panel 38 moves laterally relative to rear panel 41 (indicated by arrows 86 and 87), flaps 66 and 68 also move laterally relative to each other. Since flaps 66 and 68 are mounted to flaps 64 and 67 via hinged gluing tabs 81 and 82, the lateral movement of flaps 66 and 68 urge flaps 64 and 67 into the container with gluing tabs 81 and 82 folded along fold lines 84 and 83, respectively. Simultaneously, tabs 18 and 19 of the stand 11 move laterally with flaps 66 and 68 such that the stand attached to tabs 18 and 19 is also collapsed laterally to the flat configuration of FIG. 10.

FIG. 11*c* illustrates the bottom of the container in its fully collapsed substantially flat configuration with the bottom forming flaps folded upwardly into the container.

OPERATION

The operation of the present invention will be described first in terms of the formation of the shipping container and display stand assembly from the blanks of FIGS. 7 through 9 and then in terms of the operation of the assembled display stand and container.

To form the display panel 14 from the blank of FIG. 7, glue is applied to attachment tabs 35 and the tabs are folded along lines 36 until they are contiguous with and attached via the glue to the upper and lower panels 33 and 34. Care must be taken not to allow the glue to spread onto the support wings 25 or the pressure tabs 31 as they must be free to pivot outwardly along fold lines 32 to reinforce the display panel.

To form the container from the blank of FIG. 8, the front, back and side panels 38, 41, 37, and 39 are folded inwardly along fold lines 69, 71 and 72 forming a generally hollow rectangular shape. Tab 74 is folded along fold line 73 and attached with glue or other suitable attaching means to the free edge of side panel 37. The bottom forming flaps 64, 66, 67 and 68 are folded inwardly along fold line 76 and attached as shown in FIG. 10 to form the bottom panel of the container. Finally, the inner front tab 42 is folded inwardly along fold line 77 so that it is contiguous with front panel 38 and locking tabs 43 are received within slots 44 to maintain inner front panel 42 in its folded configuration. The generally rectangular open container 12 shown in FIG. 1 is thus formed from the blank of FIG. 8.

To form the stand from the blank of FIG. 9, the front, back and side walls are folded inwardly along fold lines 48, 49 and 50 to form a generally hollow rectangular stand. Tabs 56 and 58 are folded inwardly along fold line 55 and glued or otherwise attached to the free edge of side wall 46. The attachment tabs 18 and 19 are then mounted to bottom forming flaps 68 and 66, respectively, to form the combination shipping container and display stand assembly.

With the stand and container assembled, the entire unit can be collapsed laterally to the flat configuration of FIG. 10 if desired and several units can be stacked for shipment to the producer of goods. Upon receipt by the producer of goods, the unit is unfolded to the configuration of FIG. 1 and packed with goods. The stand 11 is then collapsed accordian style and wrapped around the container and goods for shipment to the retailer.

The shipping container and display stand is received at the retail store, packed with goods to be sold, in its shipping configuration shown in FIG. 2. Upon removal of the outer carton or wrapper, a store clerk need only hold the container 12 above the floor by grasping sides 37 and 39. The stand unfolds under the influence of the resiliency of the cardboard first to the configuration of FIG. 3, then to that of FIG. 4, and finally to the fully opened display configuration of FIG. 1. As the stand 11 unfolds from the configuration of FIG. 4 to that of FIG. 1, the front wall of the stand is urged outwardly by the lever action of the tab 27 so that the stand opens as it unfolds.

With the container 12 supported atop stand 11, the display panel 14 is folded to its upright position and support wings 25 are pivoted outwardly along fold line 32. (FIG. 6.) As the wings are pivoted, the pressure tabs 21 move into firm engagement with the back of the display panel 14 to maintain the wings in their outwardly pivoted positions. The display panel 14 is thus reinforced and maintained in its upright position by the support wings.

It is thus seen that an improved shipping container and display stand assembly is now provided that is of integral construction and requires no assembly of the stand prior to display. The assembly collapses laterally as an integrated unit to a flat configuration so that several units can be stacked for shipment to a producer of goods. Upon receipt by the producer, the unit is unfolded laterally to its open configuration and packed with goods. When packed, the stand portion folds compactly around the container and over the top thereof for shipping to the retailer. Upon receipt by the retailer, an outer wrapping is removed and the stand unfolds so that only a few seconds of a store clerk's time is required to erect the assembly. The advertising display panel is folded upwardly and the support wings are pivoted outwardly to prevent the display panel from drooping or being pulled over by customers.

What is claimed is:

1. A shipping container and display stand assembly comprising a rectangular box container including front, back and side panels and a bottom panel formed of interleaved flaps, each of said flaps being hingedly attached to a respective one of said front, back and side panels, a display stand including substantially rectangular front and back walls laterally movably connected relative to each other by opposed side walls, said front and back walls respectively being connected at corresponding ends to opposed ones of said interleaved flaps, said container and display stand assembly being foldable from a substantially flat folded configuration in which the container and display stand lie substantially flat for stacking with like containers and display stands for storage and shipment, to a container formed configuration in which the container is box-shaped for receiving goods of a producer of goods, to a display stand formed configuration in which the display stand supports the container in its box shape above a floor or other support surface.

2. The assembly of claim 1 wherein said display stand side walls include a longitudinally extending fold line for accordion folding of said display stand with said front and back walls juxtaposed and said side walls folded inwardly along said fold line between said front and back walls whereby the front and back walls can be folded with respect to said side walls to laterally displaced positions relative to each other with the side walls stretched open so that the assembly can be stacked with like containers and display stands, the display stand can be accordion folded to locate the front and back walls in overlying relationship with respect to each other with the side walls folded inwardly when the container is formed, and the front and back walls can be opened away from each other with the side walls stretched open when the display stand is in supporting relationship with respect to the container in its box-shaped configuration.

3. A collapsible shipping container and stand assembly comprising:

a container having front, back and side panels and a bottom panel defined by a plurality of bottom-forming flaps hingedly attached to the bottom portions of said front, back and side panels;

a foldable stand for supporting said container, said stand comprising opposed front and back walls connected by opposed side walls, each of said side walls having a longitudinally extending fold line for accordion folding of said stand with said front and back walls juxtaposed and said side walls folded inwardly along said fold line between said front and back walls, said back wall being hingedly connected at its upper portion to one of said bottom forming flaps adjacent said container back panel;

an elongated tab having first and second end portions and a transverse fold line intermediate said end portions, said tab being hingedly attached at its first end portion to the upper portion of said front wall and hingedly attached at its second end portion to another one of said bottom forming flaps forwardly displaced from the attachment of said back wall;

said stand, when accordion folded, being adapted to wrap at least partially around a periphery of said container to form a compact shipping configuration of said stand;

said container and stand assembly being further configured to collapse laterally as an integrated unit to a substantially flat configuration of said assembly with said bottom forming flaps folded upwardly into said container, said container front panel laterally displaced from said container back panel and said stand front wall laterally displaced from said stand back wall.

4. The shipping container and display stand assembly of claim 3 wherein said bottom forming flaps include a front flap hingedly attached to said front panel, a rear flap hingedly attached to said back panel and side flaps hingedly attached to said side panels, said flaps being configured to overlap upon being folded to right angle positions relative to said front, back and side panels to define said bottom panel, said front flap including a first gluing tab hingedly attached thereto and mounted to one of said side flaps and the other one of said side flaps including a second gluing tab hingedly attached thereto and mounted to said back flap and wherein said stand back wall is hingedly attached to said back flap adjacent said back panel and said elongated tab is hingedly attached to said front flap forwardly displaced from the attachment of said back wall, whereby lateral movement of said container front panel relative to said container back panel collapses said container and causes said front and back flaps to move laterally relative to each other urging said front, back and side flaps upwardly into said container and urging said stand to collapse laterally to a substantially flat configuration so that said stand and container collapse laterally as a unit to a flat stacking configuration .

* * * * *